US005842453A

United States Patent [19]

Hedelin

[11] Patent Number: 5,842,453

[45] Date of Patent: Dec. 1, 1998

[54] DEVICE IN A CYLINDER HEAD FOR AN INTERNAL COMBUSTION ENGINE

[75] Inventor: Lars Hedelin, Djursholm, Sweden

[73] Assignee: Fanja Ltd., Jersey, Great Britain

[21] Appl. No.: 894,008

[22] PCT Filed: Feb. 9, 1996

[86] PCT No.: PCT/SE96/00165

§ 371 Date: Sep. 12, 1997

§ 102(e) Date: Sep. 18, 1997

[87] PCT Pub. No.: WO96/24762

PCT Pub. Date: Aug. 15, 1996

[30] Foreign Application Priority Data

Feb. 10, 1995 [SE] Sweden ..... 9500486

[51] Int. Cl.[6] ..... F02D 15/04; F01L 3/20

[52] U.S. Cl. ..... 123/48 D; 123/78 D

[58] Field of Search ..... 123/78 R, 78 D, 123/48 R, 48 D

[56] References Cited

U.S. PATENT DOCUMENTS 2,062,013 11/1936 Opolo ..... 123/48 D 2,254,173 8/1941 Ericson ..... 123/48 D 5,101,776 4/1992 Ma ..... 123/78 D

*Primary Examiner*—Marguerite McMahon

*Attorney, Agent, or Firm*—Young & Thompson

[57] ABSTRACT

The invention relates to a device in a cylinder head for an internal combustion engine, said cylinder head for each cylinder comprising at least one inlet channel with an inlet valve for controlling the communication between the inlet channel and a combustion chamber, which is at least partially located in the cylinder head, and at least one outlet channel with an outlet valve for controlling the communication between the outlet channel and the combustion chamber, each of the valves being a poppet valve and being moveable between a first position in which the valve disc is in contact with a valve seat in the cylinder head to shut off the communication between the combustion chamber and the channel in question, and a second position in which the valve disc is spaced from the valve seat and opens the communication.

5 Claims, 2 Drawing Sheets

DEVICE IN A CYLINDER HEAD FOR AN INTERNAL COMBUSTION ENGINE

Cylinder heads of the above mentioned type are used in most internal combustion engines functioning as power plants for motor vehicles for example. The valves in these cylinder heads are very effective as regards controlling the gas exchange in the engine, and they are usually placed in such a manner that the valve disc is located in the combustion chamber itself.

It has been a general aim when designing internal combustion engines to increase engine efficiency by making it more adaptable to current operating conditions. By increasing the efficiency, it is intended to both reduce the fuel consumption and reduce the toxic components in the engine exhaust. To achieve this increase in efficiency under different operating conditions, there has been suggested changing the opening and closing times of the valves, changing the compression ratio and changing the system for fuel supply and ignition, with these measures being taken separately or in various combinations.

Changing the compression ratio is an effective step in increasing the efficiency of an internal combustion engine by adaptation to varying operating conditions. Devices for changing the compression ratio during operation are known, but these known devices are of complicated design and/or do not give satisfactory results in practice. Therefore there is a need for a simple device for changing the compression ratio in an internal combustion engine during the operation for adaptation to varying operating conditions.

The present invention is therefore intended to achieve a device in a cylinder head for an internal combustion engine, which device makes possible changing the compression ratio in the engine during the operation in a reliable manner. This is achieved according the invention in a device of the type described by way of introduction by virtue of the fact that the device is made with the special features disclosed in the characterizing clause of claim 1.

Specific embodiments of the invention are disclosed in the subclaims.

Figure 1:
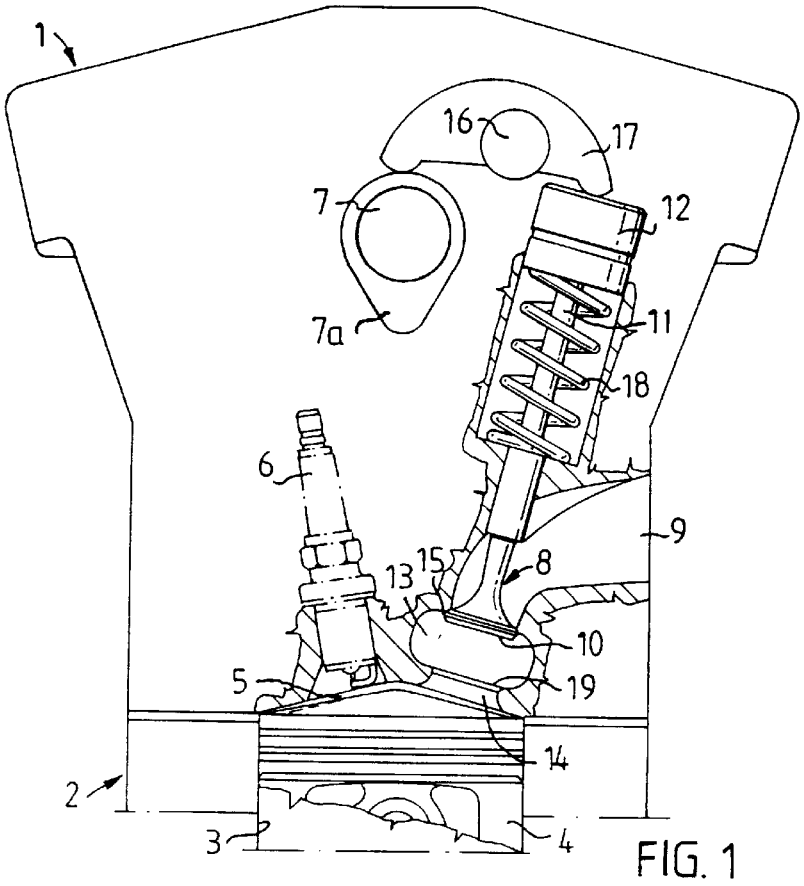
Figure 2:
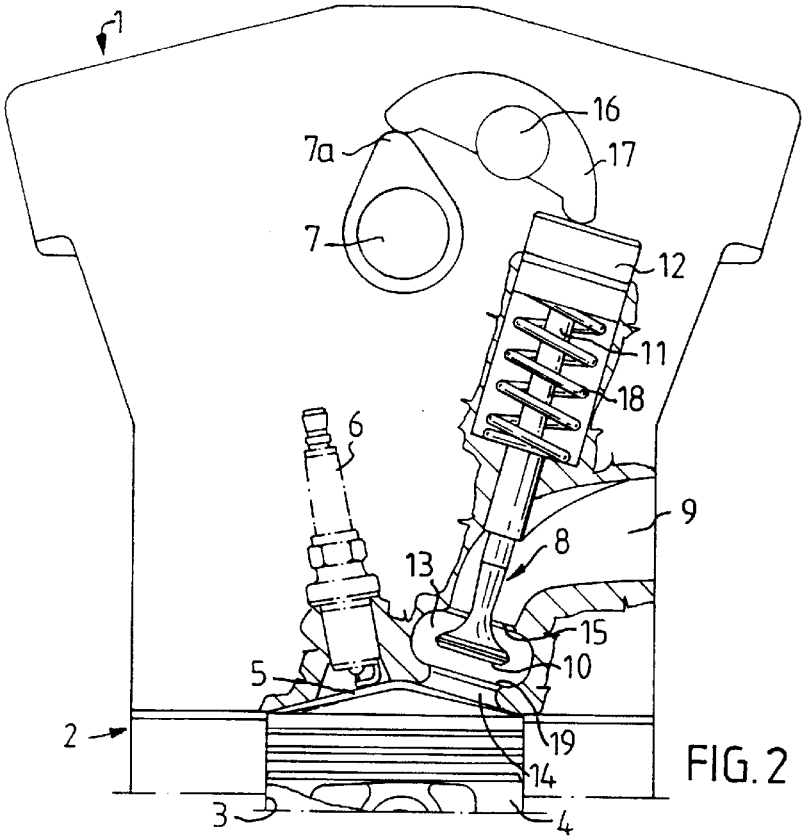
Figure 3:
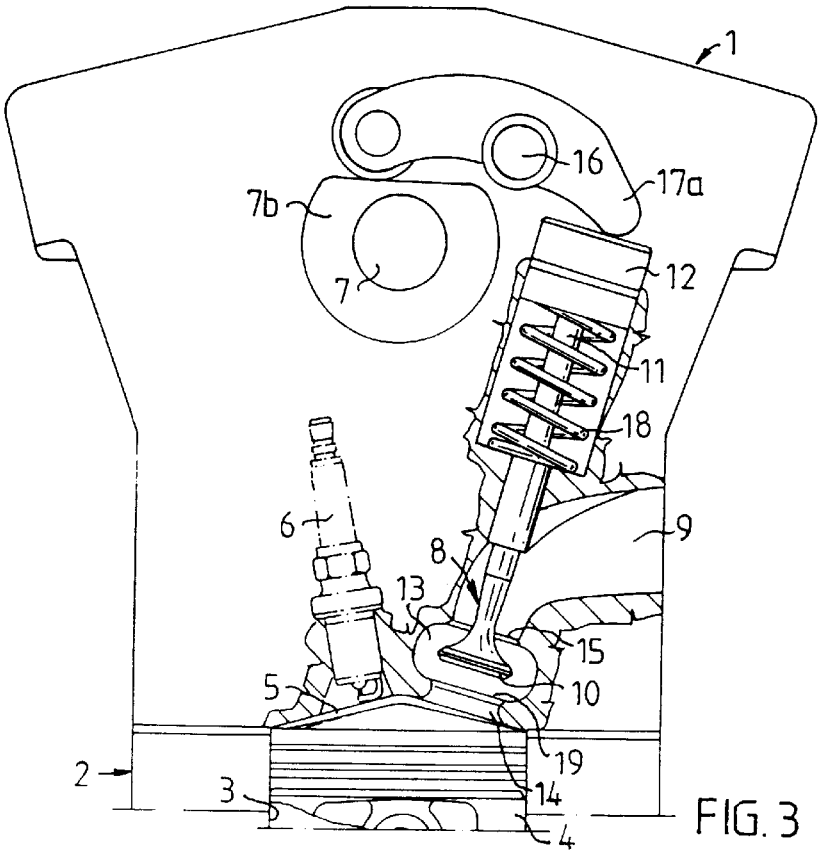
Figure 4:
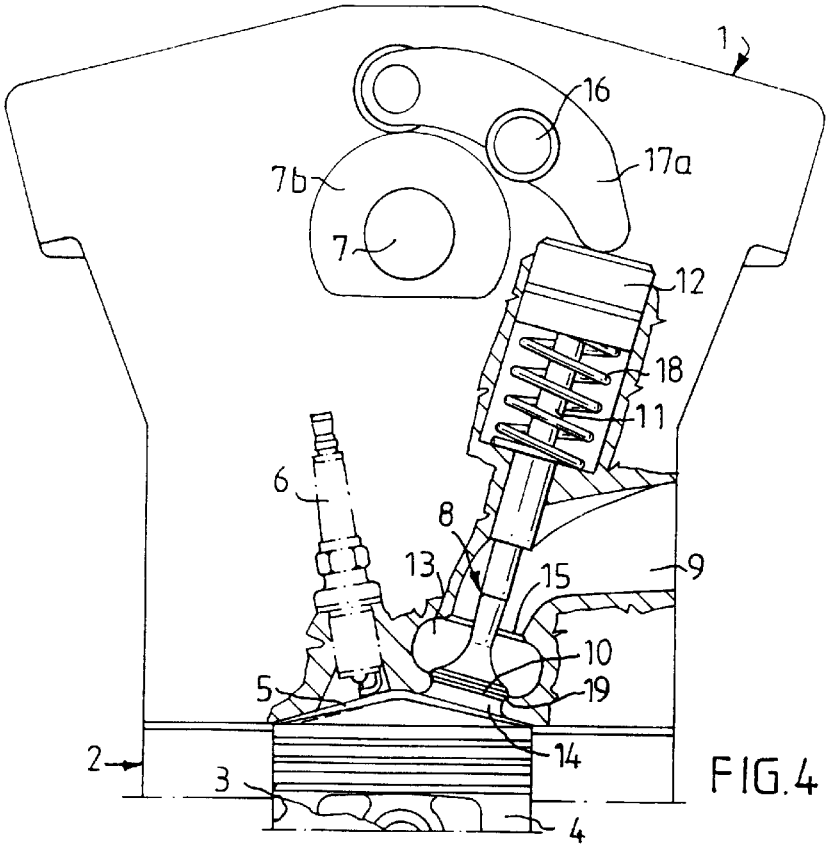

The invention will be described in more detail below with reference to the accompanying drawings, which show schematic, partially cut away views of the upper portion of an internal combustion engine, where FIG. 1 shows the engine with a valve in a first, closed position, FIG. 2 shows the engine with a valve in a second, open position, FIG. 3 shows the engine with a valve in a position corresponding to that shown in FIG. 2, but actuated by another valve mechanism, and FIG. 4 shows the engine with a valve in a third, closed position.

The drawings show very schematically a portion of an internal combustion engine, which comprises a cylinder head 1 and a cylinder block 2. Of the cylinder block 2 there is only shown an upper portion with a portion of a cylinder 3 and a piston 4 arranged therein. In the cylinder head 1 and possibly partially in the cylinder 3, above the piston 4, there is a combustion chamber 5 into which a spark plug 6 extends. There is also a cam shaft 7 mounted in the cylinder head 1.

The components described above are made in a manner corresponding to a conventional engine, but it should be observed that in a multicylinder engine there are components in a number corresponding to the number of cylinders in the engine.

FIGS. 1 and 2 show an engine with a cylinder head 1, which is made with a device according to the invention, said device working in a manner which provides a first compression ratio in the engine. In FIGS. 3 and 4, the same engine is shown as in FIGS. 1 and 2, but the device according to the invention works in a manner which provides a second compression ratio in the engine. The device according to the invention comprises a valve 8 which is arranged in a channel 9 for controlling the communication between the channel 9 and the combustion chamber 5. The channel 9 can in this case either be an inlet channel or an outlet channel, and the valve 8 is an inlet valve or an outlet valve. The valve 8 has a valve disc 10 and a valve stem 11, which at its end facing away from the valve disc 10 is actuated by a tappet 12. The valve disc 10 is placed in a wider portion of the channel 9, and this wider portion forms a chamber 13, which is in communication with the combustion chamber 5 via an opening 14.

FIG. 1 shows the valve 8 closed against a first valve seat 15, which is situated in the transition between the channel 9 and the chamber 13. The communication between the channel 9 and the combustion chamber 5 via the chamber 13 and the opening 14 is thus shut off. At the same time, the chamber 13 and the opening 14 increase the volume of the combustion chamber 5, so that there will be a predetermined compression ratio in the engine.

From the closed position shown in FIG. 1, the valve 8 can be moved to a second, open position, which is shown in FIG. 2. The valve 8 is acted on by a cam lobe 7*a* on the cam shaft 7. The cam lobe 7*a* acts on the tappet 12 via a rocker 17 mounted on a rocker shaft 16. The valve 8 thus opens against the effect of a valve spring 18, which biases the valve 8 towards its closed position. When the valve disc 10 is in its open position shown in FIG. 2, the communication between the channel 9 and the combustion chamber 5, via the chamber 13 and the opening 14, is open by virtue of the fact that the chamber 13 is of greater diameter than the valve disc 10, so that flow can occur around the valve disc 10. This means that the valve 8, when functioning as shown in FIGS. 1 and 2, will function as a conventional poppet valve in an internal combustion engine.

FIG. 3 shows the valve 8 in, in principle, the same position as shown in FIG. 2. The difference is that in FIG. 3, the valve 8 is kept in the open position by means of a rocker 17*a,* which is mounted on the rocker shaft 16 and is acted on by a cam lobe 7*b* on the cam shaft 7. From the open position shown in FIG. 3, the valve 8, by means of the cam lobe 7*b* and the rocker 17*a,* can be moved to the closed position shown in FIG. 4.

In the position shown in FIG. 4, the valve disc 10 is in sealing contact with a second valve seat 19, which is arranged in the transition between the chamber 13 and the opening 14. The valve disc 10 is thus pressed against the valve seat 19 with the aid of the cam lobe 7*b* on the cam lobe shaft 7*b,* the rocker 17*a,* the valve tappet 12 and the valve stem 11. The cam lobe 7*b* must therefore be made in such a manner that the valve disc 10 will be pressed against the second valve seat 19 with sufficient force to make the seal tight.

When the valve 8 is operating between the positions shown in FIGS. 3 and 4, the combustion chamber 5 will have an appreciably smaller volume than when the valve 8 is operating in accordance with FIGS. 1 and 2. This means that the valve working in accordance with FIGS. 3 and 4 will have a higher compression ratio in the engine.

As is evident from the above, it is possible to achieve with a device according to the invention with a single valve 8, two different compression ratios in the engine in a very simple manner. The shift between the two different compression ratios can be carried out in various manners, but this will not be described in more detail here. It should also be observed that the above description only applies to a valve, which can either be an intake valve or an exhaust valve. If both an intake valve and an exhaust valve are designed in accordance with the invention and the chambers 13 are given different volumes, it is possible to achieve four different compression ratios by changing the functioning of one, the other or both of the valves. In an engine with four valves per cylinder and all of the valves made in accordance with the invention and with different volumes of the chambers 13, it is possible to achieve an additional increase in the number of possible compression ratios. This makes possible good adaptation of the compression ratio of the engine to prevailing operating conditions, with advantages being achieved both as regards the efficiency of the engine and as regards the reduction of fuel consumption and emissions of toxic components in the engine exhaust.

The invention is not limited to the example described above but can be varied within the scope of the following patent claims.

I claim:

1. Device in a cylinder head for an internal combustion engine, said cylinder head (1) for each cylinder (3) comprising at least one inlet channel (9) with an inlet valve (8) for controlling the communication between the inlet channel and a combustion chamber (5), which is at least partially located in the cylinder head (1), and at least one outlet channel (9) with an outlet valve (8) for controlling the communication between the outlet channel and the combustion chamber, each of the valves being a poppet valve (8) and being shiftable between a first position in which the valve disc (10) is in contact with a valve seat (15) in the cylinder head (1) to shut off the communication between the combustion chamber (5) and the channel (9) in question, and a second position in which the valve disc (10) is spaced from the valve seat (15) and opens the communication, characterized in that at least one of the valves (8) for each cylinder (3) is movable to a third position, in which the valve disc (10) is in contact with a second valve seat (19) disposed in the cylinder head, that the first and the second valve seats (15,19) are spaced from each other in the channel (9) in question, and that the channel (9) is widened to a chamber (13) between the two valve seats (15,19).

2. Device according to claim 1, characterized in that the first valve seat (15) is located at the end of the chamber (13) directed towards the channel (9), and that the second valve seat (19) is located at the end of the chamber (13) directed towards the combustion chamber (5).

3. Device according to claim 1, characterized in that the chamber (13) is joined to the combustion chamber (5) by means of an opening (14).

4. Device according to claim 1, characterized in that both an inlet and an outlet valve (8) for each cylinder in the engine are made in accordance with the characterizing clause of claim 1.

5. Device according to claim 2, characterized in that the chamber (13) is joined to the combustion chamber (5) by means of an opening (14).

* * * * *